United States Patent [19]

Lutz

[11] Patent Number: 4,513,588

[45] Date of Patent: Apr. 30, 1985

[54] FLAT KNITTING MACHINE FOR THE PRODUCTION OF KNITTED PIECES WITH INTARSIA

[75] Inventor: Albert Lutz, Westhausen, Fed. Rep. of Germany

[73] Assignee: Universal Maschinenfabrik, Westhausen, Fed. Rep. of Germany

[21] Appl. No.: 559,066

[22] Filed: Dec. 7, 1983

[30] Foreign Application Priority Data

Dec. 7, 1982 [DE] Fed. Rep. of Germany ..... 3245233

[51] Int. Cl.[3] ..... D04B 15/52

[52] U.S. Cl. ..... 66/126 R

[58] Field of Search ..... 66/126 R, 127, 128

[56] References Cited

U.S. PATENT DOCUMENTS 2,602,312 7/1952 Zimic et al. ..... 66/128

4,052,865 10/1977 Zamarco ..... 66/127

4,237,706 12/1980 Patthey ..... 66/126 R

*Primary Examiner*—Ronald Feldbaum

*Attorney, Agent, or Firm*—Sughrue, Mion, Zinn, Macpeak & Seas

[57] ABSTRACT

A flat knitting machine for the production of knitted pieces with intarsia comprises a yarn guide with a yarn guide sheave mounted to be vertically displaceable on a yarn guide box, and a slider on the yarn guide box and which is displaceable horizontally and is arranged to displace the yarn guide vertically. In order to be able to lay the yarns on the one hand correctly at the first needle around and in the needle hook and on the other hand to be able to lay the yarns on the last needle of a pattern field in a correct platting position, the yarn guide comprises an entraining pin engaging in an elongate curved slot in the slider, and the elongate curved slot is formed in such a way that with a movement of the slider relative to the yarn guide box from one lateral end position to the other lateral end position the yarn guide sheave is lowered from its uppermost rest position to a lowermost loop position, is raised to a yarn-laying position, is lowered into a platting position and is raised to the rest position.

9 Claims, 13 Drawing Figures

FLAT KNITTING MACHINE FOR THE PRODUCTION OF KNITTED PIECES WITH INTARSIA

FIELD OF THE INVENTION

This invention relates to a flat knitting machine for the production of knitted pieces with intarsia, the machine comprising a yarn guide with a yarn guide sheave mounted for vertical displacement on a yarn guide box, a slider mounted for horizontal displacement on the yarn guide box and having at least two entraining edges at different vertical positions for engagement by an entrainer for the yarn guide box, wherein the entraining edges co-operate with the yarn guide in such a manner that the yarn guide is lowerable downwards into its yarn-laying position with the yarn guide box stationary and can be raised upwards from this position to its rest position.

DESCRIPTION OF THE PRIOR ART

In one known flat knitting machine of this type as described in German patent specification DE-PS No. 2459693, the yarn guides are only displaceable vertically between their lower yarn-laying position and their upper rest position, and the device for raising the yarn guide is formed in such a way that the raising of a yarn guide, after the yarn guide box has reached its end position is drawn out for long enough to ensure that the yarn laid by the yarn guide is held by closed needle hooks in the laid position. By this means it is ensured that the yarn laid in the last open needle hook is not torn out of the needle hook and consequently no faulty stitches occur.

From German published Patent Specification DE-OS No. 2910532 there is known a flat knitting machine for the production of patterned knitwear in which there is provided a curved track open on one side and connected to the carriage and having at least three different working levels, the track moving the yarn guide vertically by an entraining pin.

It is also known from German Patent Specification DE-AS No. 2448947 to provide, on the yarn guide limiters, ramp runners for an entrainer, as well as retaining latches which are pivotally mounted and which are arranged to engage with latches on the yarn guide box.

Known intarsia devices on flat knitting machines basically offer the possibility of knitting varicoloured patterns so that the yarn guide associated with each pattern field lays the yarn only over its own needle zone. In order to achieve a proper link between one pattern field and another, the yarn guides of adjacent pattern fields must lay their yarns jointly over one or more needles, whereby to create a stitch linkage. In the needles with which the linkage is knitted it is therefore necessary always to lay both yarns of adjacent pattern fields. In order that the pattern should maintain correct pattern edges, on the one hand the two yarns must be laid so that the one yarn always appears on the front side of the knitting and the other yarn always appears on the reverse side of the knitted piece. This type of knitting is known as platting. On the other hand, one has to ensure that the yarn at the edge of a pattern field, for the entrainment, is correctly laid at the first needle around and in the needle hook.

SUMMARY OF THE INVENTION

It is an object of the present invention to provide a flat knitting machine of the type first referred to above by means of which intarsia patterns can be knitted with correct pattern edges and with any combination of pattern fields, and also in which the yarns on the one hand are laid correctly at the first needle of a pattern field around and in the needle hook and on the other hand are laid in the correct platting position in the last needle of a pattern field.

This object is achieved in accordance with the present invention in that the yarn guide in a manner known per se comprises an entraining pin engageable with a curved track which is connected to the carriage and which has at least three different working levels for vertical displacement of the yarn guide, in which the curved track is an elongate curved slot in the slider which guides the entraining pin in a positive manner in both directions with the vertical movement of the yarn guide, and in which the elongate curved slot is formed such that with a movement of the slider relative to the yarn guide box from one lateral end position to the other lateral end position the yarn guide sheave (a) is lowered from its uppermost rest position to a lowermost loop position below the yarn-laying position, (b) is raised from this loop position to the yarn-laying position, (c) is lowered from the yarn-laying position to a platting position between yarn-laying position and the loop position, and (d) is raised from the platting position to the rest position.

Each yarn guide box is moved away to the edge of its pattern field by the slider being moved into the one or other lateral end position. Before the commencement of a new run of the yarn guide box the yarn is brought to lie behind the needles extended by the knitting cams by the movement of the yarn guide sheave into the loop position below the yarn-laying position, so that the yarn, for the subsequent entrainment, lies satisfactorily at the first needle around and in the needle hook. The knitting of the pattern field then follows in the yarn-laying position. By the lowering of the yarn guide sheave into a platting position below the yarn-laying position after reaching the other edge of the pattern field one achieves on the one hand a reliable laying of the yarn into the open hook of the last needle and on the other hand a satisfactory platting position, i.e. the laying of the appropriate yarn at the reverse side of the knitted piece. From the platting position the yarn guide sheave is then raised into the rest position, which basically would only then be necessary if in the subsequent carriage traverse the knitting is to be carried out without intarsia and if some other continuous pattern is to be knitted.

The elongate curved track slot is preferably arranged to be symmetrical with respect to the central transverse axis of the slider, thus resulting in a simplified construction and facilitating the control of the slider.

According to a preferred embodiment of the invention the elongate curved track slot is formed so that the yarn guide sheave, when raised into the yarn-laying position, is first raised to a high position above the yarn-laying position and is then lowered from this high position to the yarn-laying position. By this means one ensures that the yarn, even after a part of the retraction movement of the needle, is already located in the yarn-laying position for this needle.

The yarn guide box is preferably constructed symmetrically with respect to its central transverse axis, and has on each side of the axis a recessed entraining edge and also a projecting entraining edge offset with respect to the recessed entraining edge in the direction away from the central transverse axis. This arrangement of the entrairing edges causes the transfer of the yarn guide sheave from the yarn-laying position to the platting position.

The slider preferably has, arranged symmetrically on each side of its central transverse axis, a conterminous recessed and projecting entraining edge and additionally a notch offset in relation to this entraining edge in the direction away from the central transverse axis, with the side walls of the notch defining projecting entraining edges. The projecting entraining edges of the side walls of the notch serve to control the yarn guide sheave in its movement from its rest position to its lowermost loop position and from its platting position to the rest position.

The entrainer for the yarn guide box and the slider preferably has a lower, relatively small width portion and an upper, relatively large width portion. This configuration serves, in combination with the entraining edges of the yarn guide box and the conterminous recessed and projecting entraining edges of the slider, to establish and control the transfer of the yarn guide sheave from the yarn-laying position to the platting position.

Yarn guide limiters, which are horizontally displaceable by means of the machine control system, preferably are provided and include ramp runners for the entrainer which have, preferably, three inclined ramp surfaces directed towards the working region of the yarn guide and two inclined ramp surfaces directed away from this region. By means of these inclined ramp surfaces the entrainer is moved into and out of engagement with the entraining edges of the yarn guide box and of the slider at the correct times.

In order to be able to arrest the yarn guide box in its end positions at the edges of the pattern field and in order to be able to displace it jointly with the yarn guide limiters, the yarn guide limiters preferably include latching levers engageable in a controlled manner in notches in the yarn guide box and releasable from these notches.

The yarn guide limiters, together with the yarn guide boxes coupled to them, are preferably displaceable horizontally in a controlled manner during the carriage reversal by means of threaded spindles from the machine control system, corresponding to the desired pattern configuration.

The yarn guide sheave is preferably formed as a small tube which can be lowered between the needles below the needle cams. This type of sheave makes it possible to lower the sheave to the lowermost loop position reliably and without causing damage.

DESCRIPTION OF THE DRAWINGS

In order that the invention may be fully understood a preferred embodiment of knitting machine in accordance with the invention will now be described by way of example and with reference to the drawings. In the drawings.

DESCRIPTION OF THE PREFERRED EMBODIMENT

Figure 1:
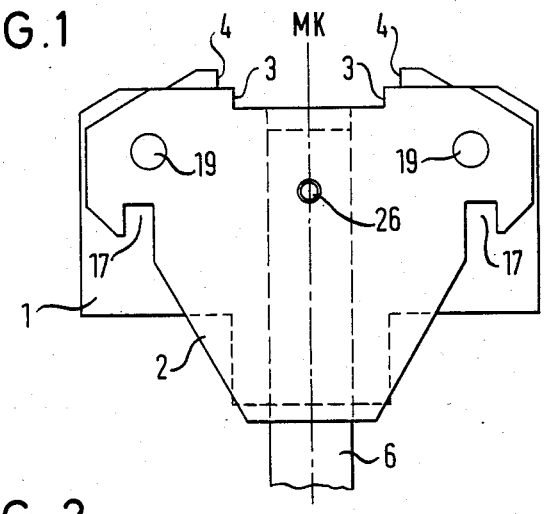
FIG. 1 shows a yarn guide box without the slider fitted thereto.

In FIG. 1 there is shown a yarn guide box 1 with a cover 2. The yarn guide box 1 is constructed symmetrically with respect to its central transverse axis MK. The yarn guide box 1 is provided, at its upper margin, with recessed entraining edges 3 and, offset relative to these edges, projecting entraining edges 4. An entrainer 5 (FIG. 2) mounted to be displaceable vertically on the carriage of the flat knitting machine is arranged to come into engagement with the entraining edges 3 and 4 upon the traverse of the carriage. A yarn guide 6 is mounted to be displaceable vertically in the yarn guide box 1.

Figure 2:
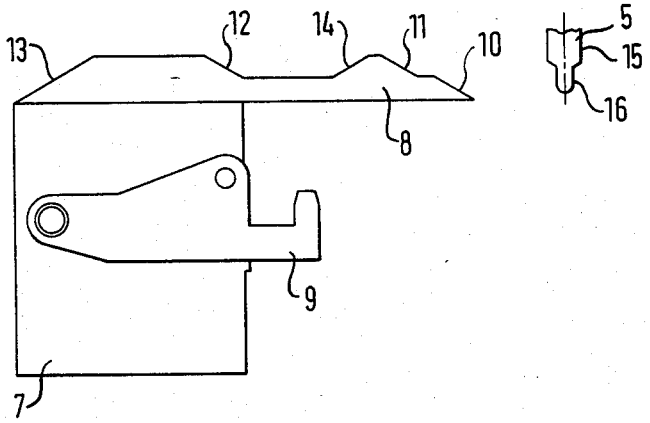
FIG. 2 shows a left-hand yarn guide limiter.

In FIG. 2 there is shown a left yarn guide limiter 7 with a ramp runner 8 and a pivotable latch lever 9. The corresponding right yarn guide limiter is constructed to be a mirror image of the left yarn guide limiter 7. The ramp runner 8 has three inclined ramp faces 10, 11 and 12 sloping towards the working zone of the yarn guide and two inclined ramp faces 13 and 14 sloping away from this zone. By means of these inclined ramp faces the entrainer 5 is raised on the carriage as the carriage traverses. The entrainer 5 itself comprises a lower, relatively small width portion and an upper relatively larger width portion, with these two portions defining entraining surfaces 16 and 15 which are offset relative to one another in the direction of carriage movement.

The latch levers 9 of the yarn guide limiters 7 are controlled in such a way that they drop into notches 17 (FIG. 1) in the cover 2 of the yarn guide box 1 in order thereby to arrest the yarn guide box 1 in its movement. The latch levers 9 are arranged to be freed from these notches 17 when the yarn guide box 1 is to be moved by the entrainer 5.

Figure 3:
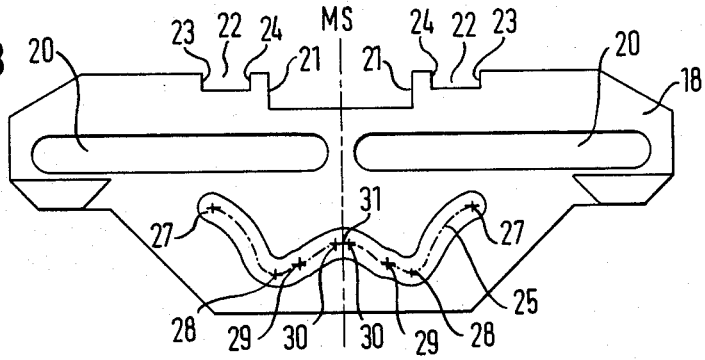
FIG. 3 shows a slider which is inserted into the yarn guide box of FIG. 1 to be horizontally displaceable relative thereto.

Within the yarn guide box 1 there is mounted a slider 18, which is shown in FIG. 3, and which is arranged to be horizontally displaeceable relative to the yarn guide box 1 by means of guide pins 19 on the yarn guide box 1 engaging in elongate holes 20 in the slider 18. The slider 18, which is symmetrical with respect to its central transverse axis MS, is provided with conterminous recessed and projecting entraining edges 21 as well as with notches 22 offset in relation to these entraining edges 21. The side walls of the notches 22 define projecting entraining edges 23 and 24. The entrainer 5 (FIG. 2) comes into engagement with the entraining edges 21, 23 and 24 for the horizontal displacement of the slider 18 relative to the yarn guide box 1 from one lateral end position to the other lateral end position.

The slider 18 also includes an elongate curved track slot 25 in which an entraining pin 26 (FIG. 1) of the yarn guide 6 engages. By means of a horizontal displacement of the slider 18 relative to the yarn guide box 1, the yarn guide 6, together with the yarn guide sheaves attached to it, is moved into different vertical positions by the co-operative action of the elongate curved track slot 25 and the entraining pin 26, with the result that the vertical position of the entraining pin 26 in each case corresponds to the vertical position of the yarn guide sheave. These positions of the entraining pin 26, and consequently of the yarn guide sheave, are, in particular, an uppermost rest position 27, a lowermost loop position 28, a higher platting position 29 and a yarn-laying position 30, these positions being repeated symmetrically on each side of the central transverse axis MS of the slider 18. A high position raised above the yarn-laying position 30 lies on the central transverse axis MS itself.

Figure 4:
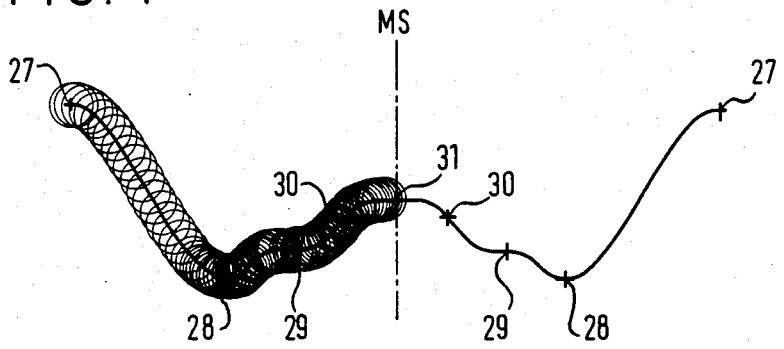
FIG. 4 shows an elongate curved track slot of the slider according to FIG. 3 on an enlarged scale.
Figure 5:
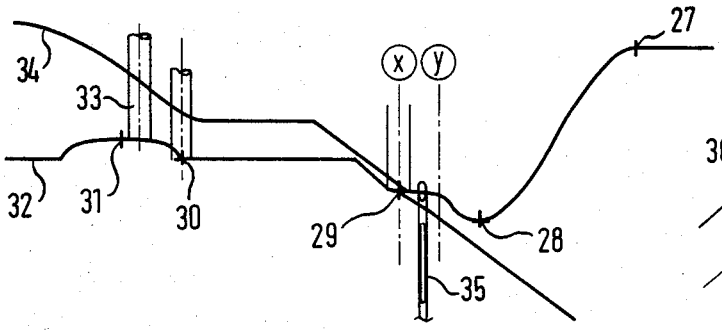
FIG. 5 is a schematic representation of the path of the needle and of the yarn guide sheave with respect to time.
Figure 6:
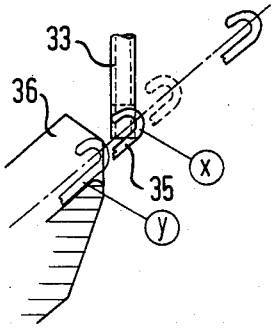
FIG. 6 shows various needle positions.

In FIG. 4 the elongate curved track slot 25 is shown on an enlarged scale. FIG. 5 shows the path 32 of a yarn guide sheave 33 during the lowering and raising of the yarn guide 6 in relation to the path 34 of a needle 35 during this movement of the sheave. FIG. 6 shows various different positions of the needle 35 relative to the needle cam 36.

After the yarn guide sheave has been lowered from the uppermost rest position 27 to the lowermost loop position 28, the cam unit (not shown) brings the needles into the extended position, in consequence of which the yarn comes to lie behind the needles which have been extended and for the following entrainment, lies correctly in and around the needle hook at the first needle of a pattern field. The yarn guide sheave is then raised into the yarn-laying position 30 in which knitting occurs in the relevant pattern field. With vertical displacement of the yarn guide sheave from the loop position 28 to the yarn-laying position 30 the yarn guide sheave is guided above the high position 31. This means that the yarn-laying position relative to the needle occurs not only with vertically unmoved yarn guide sheaves, but already before the vertical standstill of the yarn guide sheave.

After the movement of the yarn guide box away from the upper edge of a pattern field, the yarn guide sheave is lowered from the yarn-laying position 30 to the platting position 29. Thereby, on the one hand the yarn is brought to lie with certainty at the back of the knitted piece and on the other hand one ensures that the yarn cannot escape from the now open needle hook. The raising of the yarn guide sheave into the rest position 27 which then follows serves to prepare the yarn guide for the next pattern traverse in the opposite direction.

Figure 7:
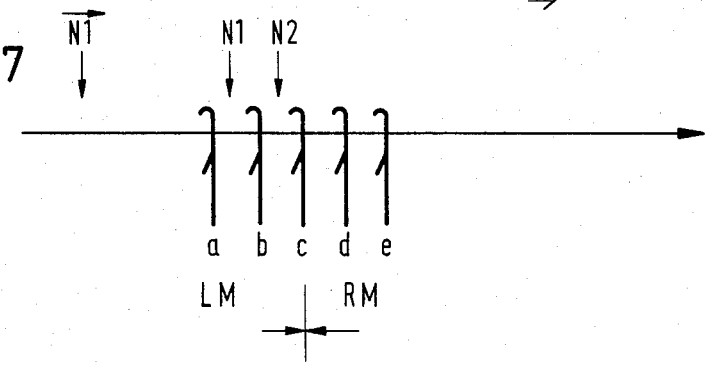
FIG. 7 and 8 are schematic representations of yarn guide sheaves in relation to needles; and, FIGS. 9 to 13 are five illustrations of a yarn guide box with slider inserted therein for different positions of the slider relative to the yarn guide box and for different positions of the entrainer relative to the individual entraining edges.
Figure 8:
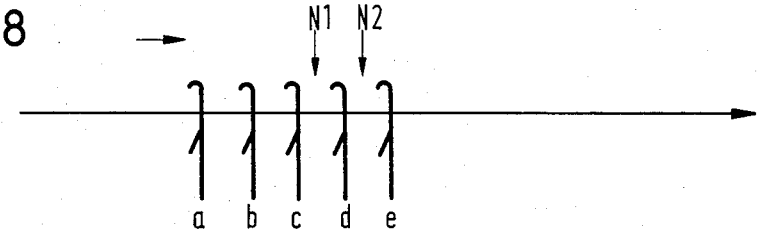
Figure 9:
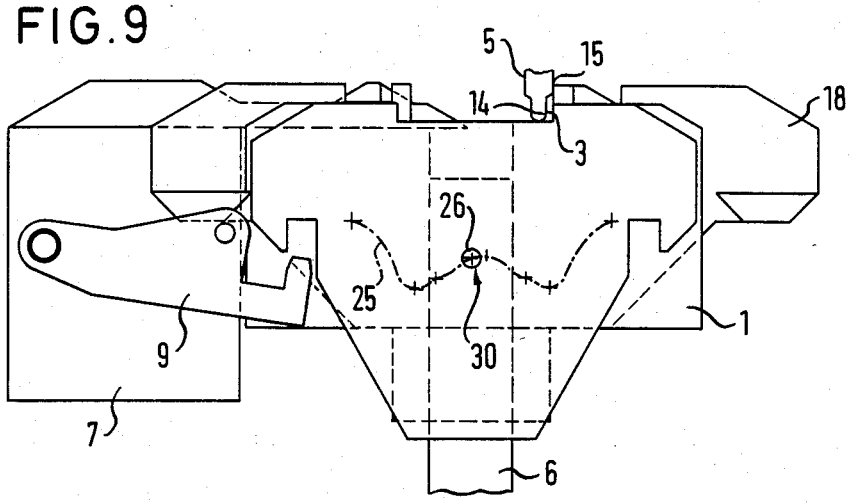
Figure 10:
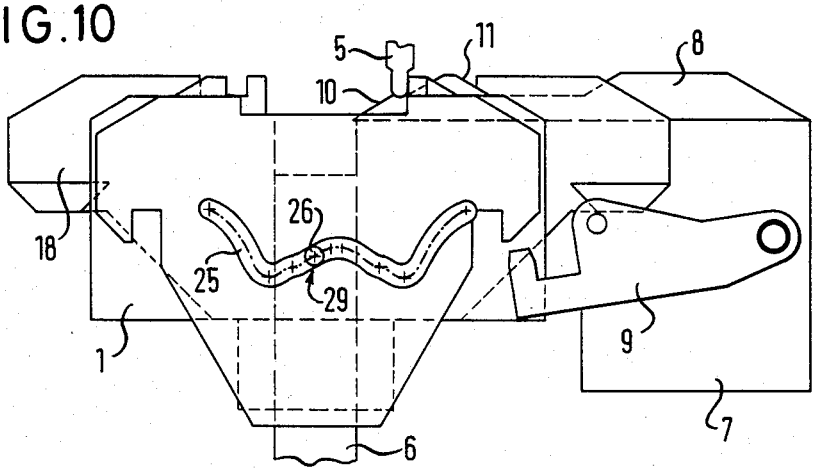

FIGS. 7 and 8 show two yarn guide sheaves N1 and N2 in their settings and positions relative to needles a, b, c, d and e, wherein a left pattern field is indicated at LM and a right pattern field is indicated at RM. FIGS. 9 to 13 show various different positions of the slider 18 relative to the yarn guide box 1 in which the yarn guide in FIG. 9 is in the yarn-laying position for knitting from left to right, and in which FIG. 10 shows the yarn guide in the platting position.

The needle c is that needle which serves as a connecting point between the two pattern fields LM and RM. The yarn guide with the yarn guide sheave N1 (FIG. 7) is in the knitting position and moves to the right (FIG. 9), with the entrainer 5 being in engagement with the slider 18 and the yarn guide box 1 in such a way that it entrains the entraining edge 21 of the slider 18 by means of its entraining surface 15 and entrains the entraining edge 3 of the yarn guide box 1 by means of its entraining surface 16. It moves up to a position between needles a and b (FIG. 7). There, the entrainer 5 runs on the inclined ramp surface 10 of the ramp runner 8 (FIG. 10).

Figure 11:
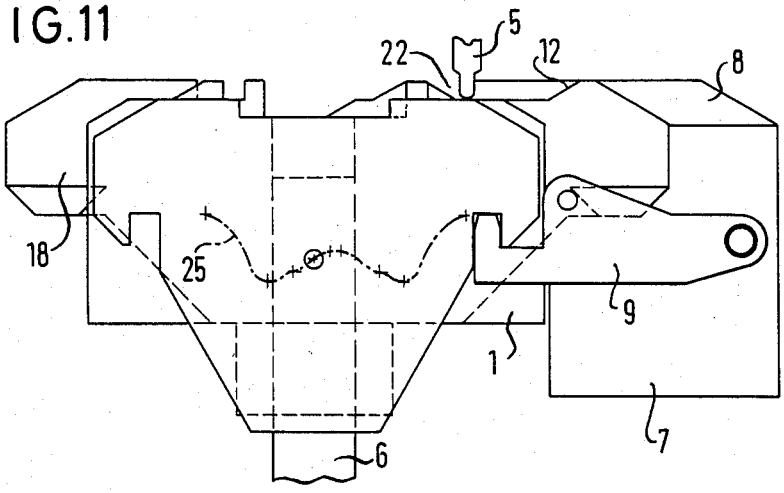

The yarn guide box 1 remains stationary for a short time, while the slider 18 travels further, until the lower entraining surface 16 of the entrainer 5 again picks up the yarn guide box 1. During this movement the entraining pin 26 has dropped lower in the elongate curved track slot 25 and consequently the associated yarn guide sheave has dropped somewhat lower into the platting position 29. The latch lever 9 of the right-hand yarn guide limiter 7 is opened for subsequent latching. The yarn guide sheave N1 and the yarn guide sheave N2 of the next-following yarn guide have approached one another until they are one needle division apart (FIG. 7) and then run together jointly over a distance equal to two needle divisions or needles. The entrainer 5 runs on the inclined ramp surface 11 of the right-hand ramp runner 8, uncouples the yarn guide box 1 and finally drops into the notch 22 in the slider 18 (FIG. 11). The slider 18 is now taken so far to the right until the entrainer 5 is raised by the inclined ramp surface 12 of the right-hand ramp runner 8, whereupon it remains stationary. The slider 18 has consequently reached its right-hand end position, in which the yarn guide sheave is in the uppermost rest position.

Figure 12:
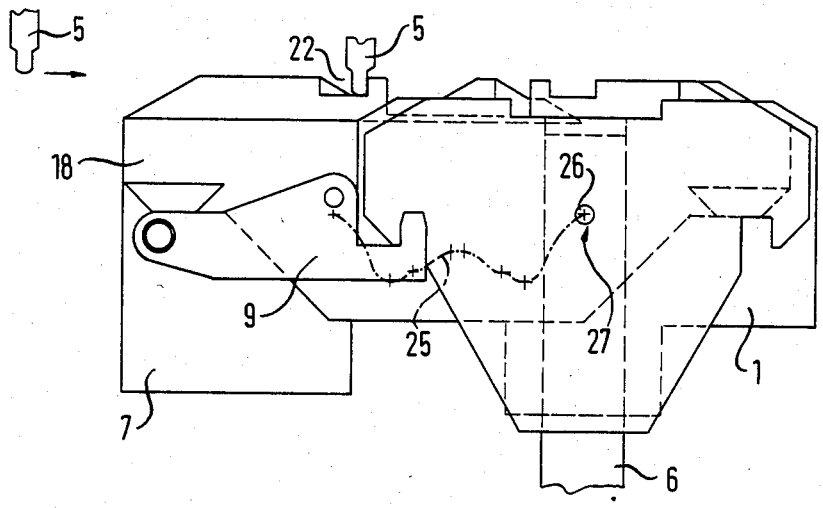
Figure 13:
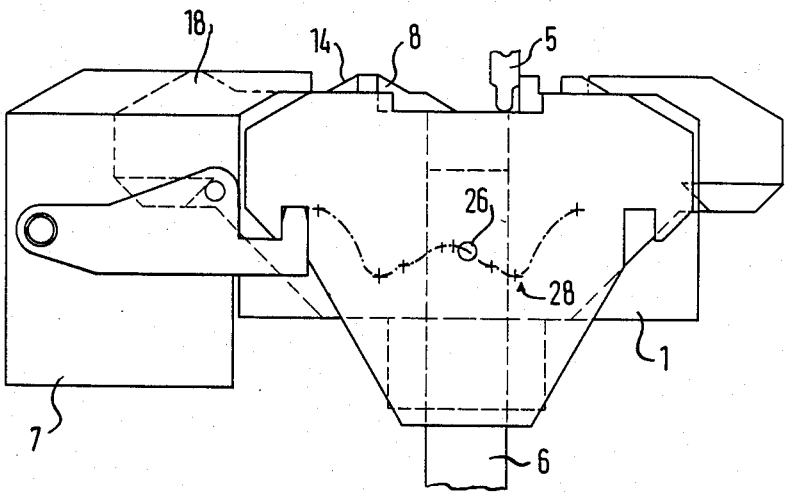

Before the right-hand yarn guide box 1 with its yarn guide sheave N2 can be entrained, the entrainer 5, by means of the ramp runner 8 of the left-hand yarn guide limiter 7, drops into the notch 22 of the slider 18 (FIG. 12). The slider 18 therefore moves to the right, and the yarn guide box 1 is then held by the left-hand latch lever 9, slides over the inclined ramp surface 14, thereby uncoupling the slider 18, and slides in the central recesses of the slider 18 and of the yarn guide box 1 between the entraining edges 21, 21 and 3, 3 until shortly before the decoupling from the latch lever (FIG. 13). During this time the yarn guide sheave N2 has dropped into the lowermost loop position 28 and the entraining pin 26 occupies the position shown in FIG. 13. This movement of the sheave occurs while the yarn guide box 1 itself does not move and while the yarn guide sheave N2 still stands between the needles b and c (FIG. 7).

In the preceding row of knitting, i.e. with knitting from right to left, the yarn guide sheave N2 has dispensed the yarn for the formation of the stitch to the needle b as the last needle. The yarn guide sheave N2 stands between the needles a and b. During the reversal of the carriage at the left-hand end of the machine the yarn guide box 1 with the yarn guide sheave N2 is displaced to the right by one division beyond the left-hand yarn guide limiter 7, for example by means of a threaded spindle, so that with traverse of the carriage to the right the yarn guide sheave N2 is positioned between needles b and c (FIG. 7).

While the yarn guide sheave N2 occupies its lowermost position, i.e. the loop position, the cam unit on the carriage brings the needles into the extended position so that the yarn comes to lie behind the extended needles and lies for the subsequent entrainment correctly in and around the needle hook at the first needle of the pattern field. This is particularly important if the lateral position of the pattern field suddenly wanders to the left for example over several needles. With the reversal of the carriage at the left-hand end of the machine the connecting point between the pattern field would then be displaced to the left by several needles. It is therefore necessary to use a long-drawn yarn which can be brought reliably behind the extended needles and this would be achieved with the lowering of the yarn guide sheave into the lowermost loop position. Subsequently, the slider 18 is again displaced to the right by the entrainer 5 until it takes up the position shown in FIG. 9 in which knitting takes place.

As is shown in FIG. 6, the yarn guide sheave 33 is preferably formed as a small tube which can be lowered between the needles 35 below the needle cams 36.

I claim:

1. A flat knitting machine for the production of knitted pieces with intarsia, comprising a yarn guide with a yarn guide sheave mounted for vertical displacement on a yarn guide box, and a slider mounted for horizontal displacement on the yarn guide box and provided with at least two entraining edges at different vertical positions for engagement by an entrainer for the yarn guide box, said entraining edges co-operating with the yarn guide in such a manner that the yarn guide is lowerable downwards into its yarn-laying position with the yarn guide box stationary and can be raised upwards into its rest position from the yarn-laying position, wherein the yarn guide comprises an entraining pin engageable with a curved track which is connected to the carriage and has at least three different working levels for vertical displacement of the yarn guide, wherein the curved track comprises an elongate curved slot in the slider which guides the entraining pin positively in both directions with the vertical movement of the yarn guide, and wherein the elongate curved slot is formed such that with a movement of the slider relative to the yarn guide box from one lateral end position to the other lateral end position the yarn guide sheave (a) is lowered from its uppermost rest position to a lowermost loop position below the yarn-laying position, (b) is raised from this loop position to the yarn-laying position, (c) is lowered from the yarn-laying position to a platting position between the yarn-laying position and the loop position, and (d) is raised from the platting position to the rest position.

2. A flat knitting machine according to claim 1, in which the elongate curved slot is formed symmetrically with respect to the central transverse axis of the slider.

3. A flat knitting machine according to claim 1, in which the elongate curved slot is formed such that the yarn guide sheave, when raised into the yarn-laying position, is first raised to a high position above the yarn-laying position and is then lowered from this high position to the yarn-laying position.

4. A flat knitting machine according to claim 1, in which the yarn guide box is constructed symmetrically with respect to its central transverse axis, and includes on each side of the axis a recessed entraining edge and a projecting entraining edge offset relative to the recessed entraining edge away from the central transverse axis.

5. A flat knitting machine according to claim 4, in which the slider is provided, symmetrically on each side of its central transverse axis, with a conterminous recessed and projecting entraining edge and with a notch offset with respect to this entraining edge on the side remote from the central transverse axis, with the side walls of the notch defining projecting entraining edges.

6. A flat knitting machine according to claim 1, which includes a horizontally displaceable yarn guide limiter comprising a ramp runner for the entrainer having three inclined ramp surfaces directed towards the working region of the yarn guide and two inclined ramp surfaces directed away from said working region.

7. A flat knitting machine according to claim 6, in which the yarn guide limiter comprises a latch lever engageable in a controlled manner in a notch in the yarn guide box and releasable from said notch.

8. A flat knitting machine according to claim 7, in which the yarn guide limiter, together with the yarn guide box coupled to it, is displaceable horizontally in a controlled manner during the carriage reversal by threaded spindle means.

9. A flat knitting machine according to claim 1, in which the yarn guide sheave is formed as a small tube which can be lowered between the needles below the needle cams.

* * * * *

UNITED STATES PATENT AND TRADEMARK OFFICE

CERTIFICATE OF CORRECTION

PATENT NO. : 4,513,588

DATED : April 30, 1985

INVENTOR(S) : Albert LUTZ

It is certified that error appears in the above-identified patent and that said Letters Patent is hereby corrected as shown below: Title page:

[73] Assignee: Universal Maschinenfabrik
Dr. Rudolf Schieber GmbH & Co. KG

Signed and Sealed this

Fourth Day of November, 1986

[SEAL]

*Attest:*

DONALD J. QUIGG

*Attesting Officer*

*Commissioner of Patents and Trademarks*